US008858239B2

(12) United States Patent
Little et al.

(10) Patent No.: US 8,858,239 B2
(45) Date of Patent: Oct. 14, 2014

(54) ELECTRICAL CONNECTOR ASSEMBLY FOR BLIND MATING FOR BOARD TO BOARD USE

(75) Inventors: Terrance F. Little, Fullerton, CA (US); Ming-Ching Chen, New Taipei (TW); Hung-Yang Yeh, New Taipei (TW); Chia-Pin Liu, New Taipei (TW); Chih-Hsiang Ho, New Taipei (TW); Richard Lee Malehorn, II, York, PA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 159 days.

(21) Appl. No.: 13/565,730

(22) Filed: Aug. 2, 2012

(65) Prior Publication Data

US 2013/0337698 A1 Dec. 19, 2013

Related U.S. Application Data

(63) Continuation-in-part of application No. 13/526,538, filed on Jun. 19, 2012, now Pat. No. 8,764,470.

(51) Int. Cl.
*H01R 12/00* (2006.01)

(52) U.S. Cl.
USPC ..... 439/74

(58) Field of Classification Search
CPC ..... H01R 23/27
USPC ..... 439/74, 284, 290, 291
See application file for complete search history.

(56) References Cited

U.S. PATENT DOCUMENTS

| | | | | |
|---|---|---|---|---|
| 5,376,009 | A * | 12/1994 | Olsson et al. | 439/67 |
| 5,498,167 | A * | 3/1996 | Seto et al. | 439/74 |
| 5,876,217 | A * | 3/1999 | Ito et al. | 439/74 |
| 5,975,916 | A * | 11/1999 | Okura | 439/74 |
| 6,379,170 | B1 | 4/2002 | Czeschka et al. | |
| 6,702,590 | B2 * | 3/2004 | Zaderej et al. | 439/74 |
| 6,881,075 | B2 * | 4/2005 | Huang et al. | 439/74 |
| 6,986,670 | B2 * | 1/2006 | Okura et al. | 439/74 |
| 7,172,433 | B2 * | 2/2007 | Tsai | 439/74 |
| 7,179,108 | B2 * | 2/2007 | Goodman et al. | 439/284 |
| 7,182,608 | B2 * | 2/2007 | Soh et al. | 439/74 |
| 7,320,605 | B2 * | 1/2008 | Chang et al. | 439/74 |
| 7,467,954 | B2 * | 12/2008 | Shiu | 439/74 |
| 7,748,993 | B2 * | 7/2010 | Midorikawa et al. | 439/74 |
| 7,798,836 | B2 * | 9/2010 | Lappoehn | 439/291 |
| 8,182,272 | B2 * | 5/2012 | Ooi | 439/74 |
| 8,192,217 | B2 * | 6/2012 | Zhu | 439/284 |
| 8,408,931 | B2 * | 4/2013 | Sato et al. | 439/357 |
| 8,602,811 | B2 * | 12/2013 | Takahashi | 439/376 |
| 8,668,511 | B2 * | 3/2014 | Guo | 439/291 |
| 2009/0081903 | A1 * | 3/2009 | Zhang et al. | 439/626 |
| 2012/0088386 | A1 * | 4/2012 | Guo | 439/284 |
| 2013/0149908 | A1 * | 6/2013 | Little et al. | 439/660 |
| 2013/0260588 | A1 * | 10/2013 | Chen | 439/284 |

* cited by examiner

*Primary Examiner* — Neil Abrams
(74) *Attorney, Agent, or Firm* — Ming Chieh Chang; Wei Te Chung

(57) ABSTRACT

An electrical connector assembly includes a female connector (100) and a male connector (200) mating with each other. Each of the female connector and the male connector includes a housing (1, 4) and a number of terminals (2, 5) secured in the housing. The housing has a number of channels and a number of standoffs (13) arranged alternately along a lengthwise direction, and a number of indentations (14) each defined beside a corresponding standoff. Two adjacent standoffs are staggered. Each terminal has a contacting section. The contacting sections of the terminals of the female connector contact with those of the terminals of the male connector. The standoffs of the male connector engage with the indentations of the female connector.

19 Claims, 9 Drawing Sheets

ELECTRICAL CONNECTOR ASSEMBLY FOR BLIND MATING FOR BOARD TO BOARD USE

CROSS-REFERENCE TO RELATED APPLICATIONS

This patent application is related to U.S. patent application Ser. No. 13/315,549, filed on Dec. 9, 2011, entitled "HERMAPHRODITIC BOARD TO BOARD CONNECTOR AND ASSEMBLY THEREOF WITH OFFSET CONTACT ARRANGEMENT", U.S. Design patent application Ser. No. 29/417,994, filed on Apr. 11, 2012, and Ser. No. 29/417,995, filed on Apr. 11, 2012, both entitled "ELECTRICAL CONNECTOR," and is a continuation-in-part of U.S. patent application Ser. No. 13/526,538, filed on Jun. 19, 2012, entitled "BOARD TO BOARD CONNECTOR WITH ENHANCED METAL LOCKING FEATURES" which are assigned to the same assignee with this application.

BACKGROUND OF THE INVENTION

1. Field of the Invention

The present invention relates to an electrical connector assembly, and more particularly to a board to board connector assembly having hermaphroditic configuration and capable of blind mating.

2. Description of Related Art

U.S. Patent Application Publication No. 2009/0081903 published on Mar. 26, 2009 discloses a board to board connector including a female connector and a male connector having a same configuration. Each of the male connector and the female connector has a housing and a plurality of terminals mounted in the housing. Each terminal has a body portion, a curved resilient contacting arm, a vertical stiff contacting arm, and a pair of tail portions extending outwardly from opposite ends of the body portion. The stiff contacting arm of the male connector is sandwiched between the resilient contacting arm and the stiff contacting arm of the female connector. The resilient contacting arm of the male connector contacts with the stiff contacting arm of the female connector.

An electrical connector assembly having hermaphroditic configuration and capable of blind mating is desired.

SUMMARY OF THE INVENTION

Accordingly, an object of the present invention is to provide an electrical connector assembly having hermaphroditic configuration and capable of blind mounting.

In order to achieve the object set forth, an electrical connector assembly includes female connector and a male connector mating with each other. Each of the female connector and the male connector includes a housing and a plurality of terminals secured in the housing. The housing has a plurality of channels and a plurality of standoffs arranged alternately along a lengthwise direction, and a plurality of indentations each defined beside a corresponding standoff. Two adjacent standoffs are staggered. Each terminal has a contacting section. The contacting sections of the terminals of the female connector contact with those of the terminals of the male connector. The standoffs of the male connector engage with the indentations of the female connector.

The male connector moves on the female connector till the standoffs of the male connector align with the corresponding indentations of the female connector and the standoffs of the female connector align with the corresponding indentations of the male connector along a mating direction. The mating process could be performed at that position. The staggered standoffs and the indentations are used for blind mating.

Other objects, advantages and novel features of the invention will become more apparent from the following detailed description when taken in conjunction with the accompanying drawings.

DETAILED DESCRIPTION OF THE PREFERRED EMBODIMENT

Figure 1:
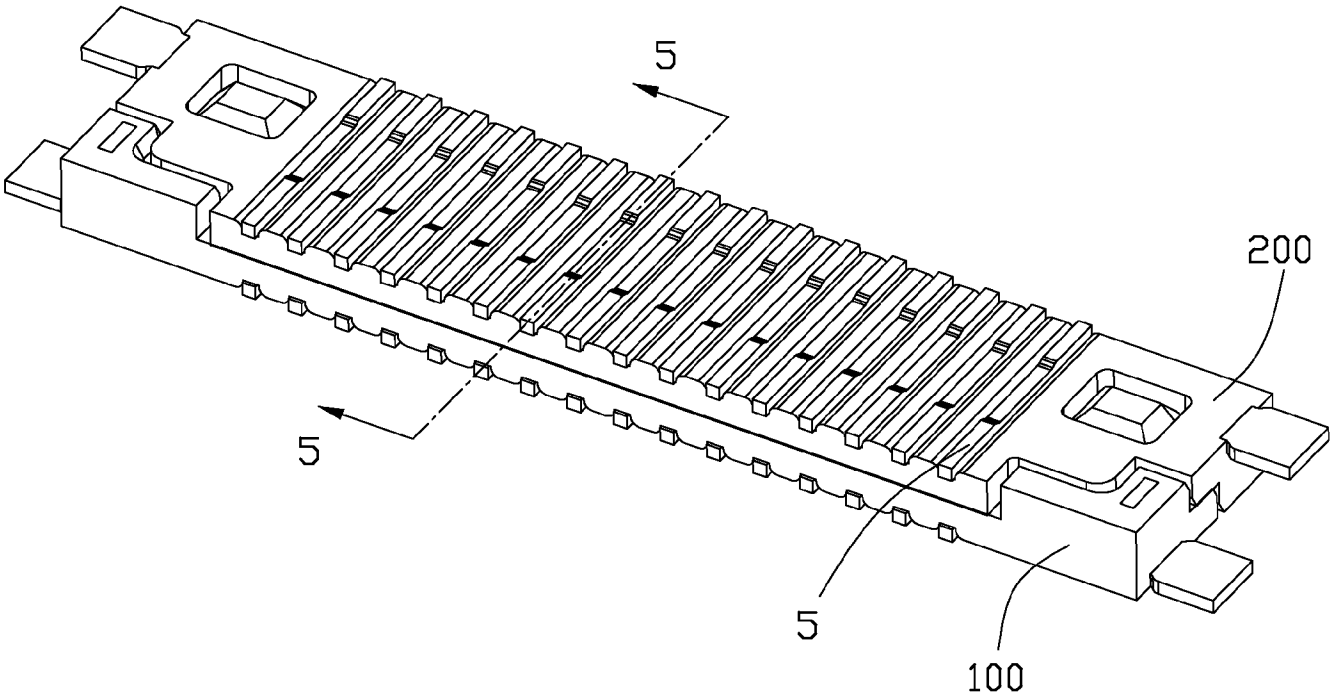
FIG. 1 is an assembled perspective view showing an electrical connector assembly in accordance with a first embodiment of the present invention.

Reference will now be made in detail to the preferred embodiment of the present invention. Referring to FIGS. 1-5, an electrical connector assembly with hermaphroditic configuration comprises a female connector 100 and a male connector 200 mating with each other. The female connector 100 and the male connector 200 have identical configurations and are electrically connected with a mother board (not shown) and a daughter board (not shown).

The female connector 100 includes a female housing 1, a plurality of female terminals 2 secured in the female housing 1 and a pair of female retention portions 3.

Figure 2:
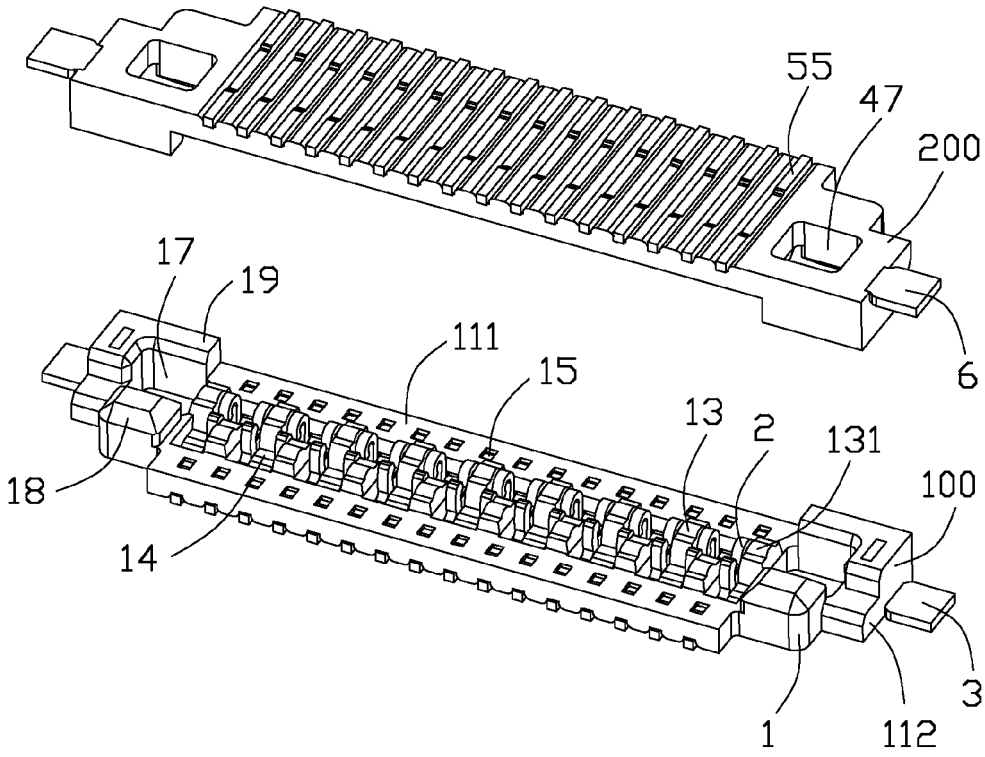
FIG. 2 is a perspective view showing a female connector and a male connector of the electrical connector assembly in FIG. 1.
Figure 3:
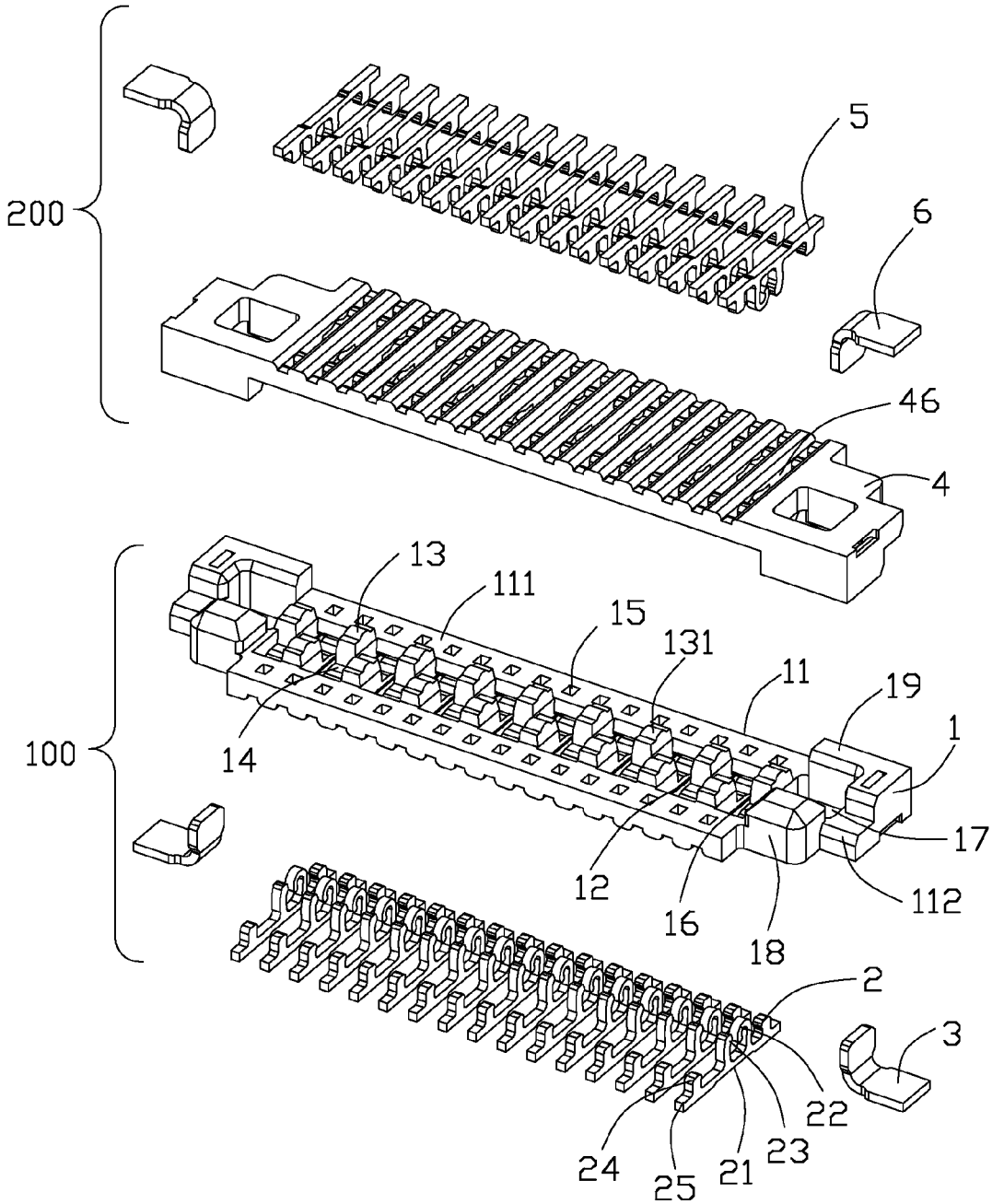
FIG. 3 is an exploded view showing the electrical connector assembly.
Figure 4:
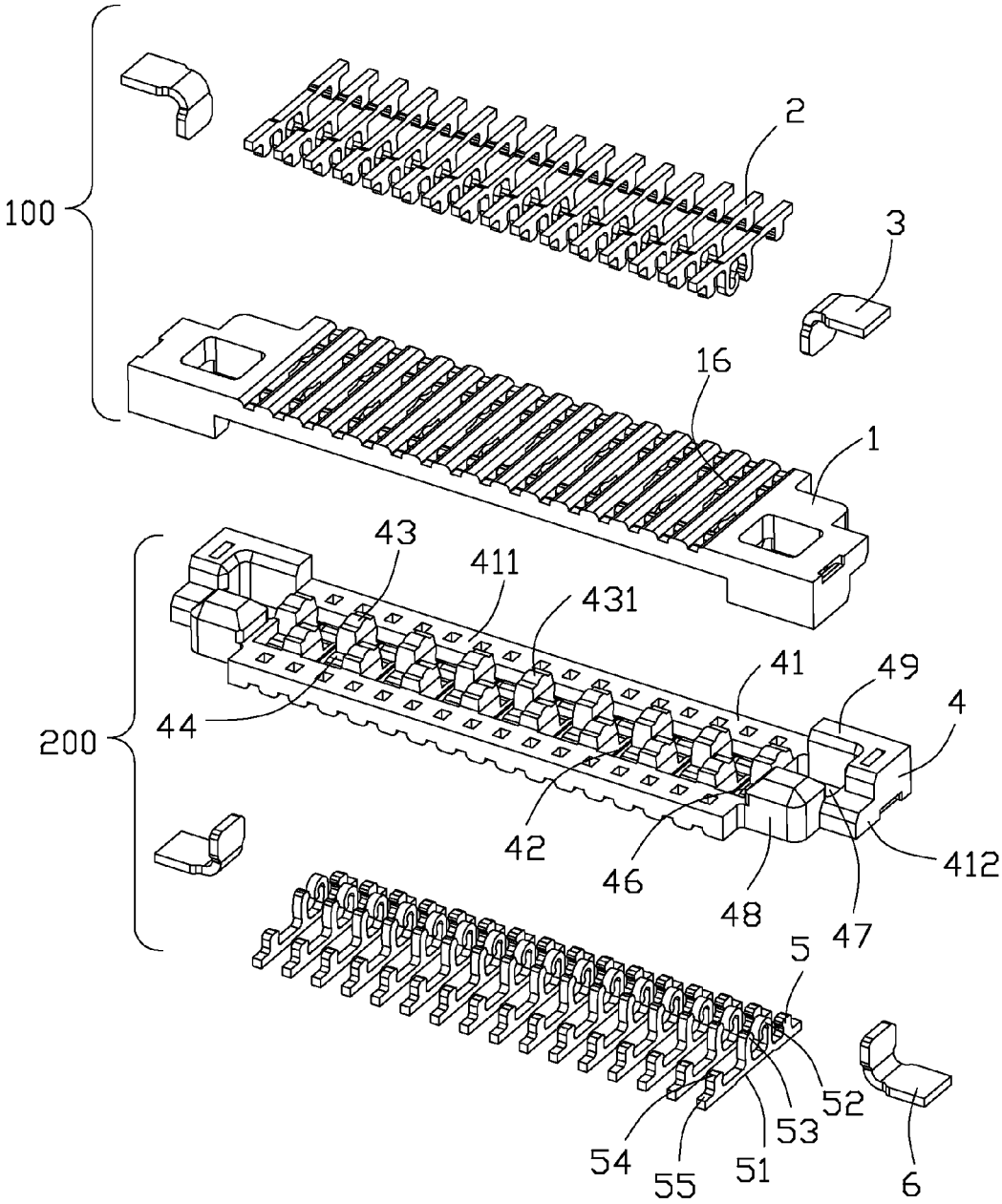
FIG. 4 is another exploded view similar to FIG. 3, taken from another aspect.

The female housing 1 comprises a base 11 and a lake portion 12 defined in the base 11. The base 11 includes a pair of side walls 111, a pair of end portions 112 surrounding the lake portion 12, a plurality of standoffs 13 standing upwardly from the lake portion 12, and a plurality of indentations 14 each beside and aligned with the corresponding standoff 13 along a width direction. The female housing 1 further defines a plurality of channels (not labeled) communicating with the lake portion 12. The channels and the standoffs 13 are arranged alternately along a lengthwise direction perpendicular to the width direction. Two adjacent standoffs 13 are staggered for assured complete contact protection and blind mating. As shown in FIGS. 2 and 3, each standoff 13 in the first embodiment has an emboss 131 with a curved upper surface formed at a top of the standoff 13. Such a feature could be applied in the second embodiment. Each channel includes a passageway 16 defined in the lake portion 12 and extending through a floor face of the base 11, and a pair of slits 15 respectively defined through the pair of side walls 111.

Each end portion 112 includes a guiding post 18, a guiding hole 17 beside the guiding post 18, and an integrated L-shaped enhanced wall 19. Such a feature could not be applied not only in the first embodiment, but also in the second embodiment.

Referring to FIGS. 1-4, in a first embodiment, the female terminals 2 of the female connector 100 have same configurations. Each female terminal 2 includes a body portion 21, a pair of tail portions 25 extending from opposite ends of the body portion 21, a pair of barb portions 24 respectively standing on the pair of tail portions 25, and a contacting section (not labeled) between the pair of barb portions 24. The contacting section of each female terminal 2 comprises a stiff contacting arm 23 having a hook portion 231 and a curved resilient contacting arm 22 having a free end bent toward the stiff contacting arm 23. Each tail portion 25 has a flat outer surface for being surface mounted or soldered on the mother board.

In assembling of the female connector 100, the body portion 21 of each female terminal 2 is mounted in the passageway 16 of a corresponding channel and exposed outwardly through the floor face of the housing 1. The pair of barb portions 24 of each female terminal 2 are secured in the pair of slits 15 of the corresponding channel. The contacting sections of the female terminals 2 in the female connector 100 are aligned with each other along the lengthwise direction. The standoffs 13 are resisted against by the contacting sections of the female terminals 2. The embosses 131 are flush with, or project beyond the contacting sections of the female terminals 2 for protecting the contacting sections in the mating process. The pair of female retention portions 3 are insert molded with the female housing 1 for being surface mounted or soldered on the mother board.

The male connector 200 includes a male housing 4, a plurality of male terminals 5 secured in the male housing 4 and a pair of male retention portions 6.

The male housing 4 has a configuration identical to that of the female housing 1 and comprises a base 41 and a lake portion 42. The base 41 includes a pair of side walls 411, a pair of end portions 412, a plurality of standoffs 43 and a plurality of indentations 44. The male housing 4 further defines a plurality of channels. Each indentations 44 is beside and aligned with the corresponding standoff 43 along the width direction. The channels and the standoffs 43 are arranged alternately along a lengthwise direction. Two adjacent standoffs 33 are staggered. Each channel includes a passageway 46, and a pair of slits 45. As shown in FIGS. 1-4, each standoff 43 has an emboss 431. Each end portion 412 includes a guiding post 48, a guiding hole 47, and an integrated L-shaped enhanced wall 49.

The male terminal 5 has a configuration identical to that of the female terminal 2. Referring to FIGS. 1-4, in the first embodiment, the male terminals 5 of the male connector 200 have same configurations. Each male terminal 5 includes a body portion 51, a pair of tail portions 55, a pair of barb portions 54, and a contacting section (not labeled). The contacting section of each female terminal 5 comprises a stiff contacting arm 53 having a hook portion 531 and a curved resilient contacting arm 52.

In assembling of the male connector 200, the body portion 51 of each male terminal 5 is mounted in the passageway 46 of a corresponding channel and exposed outwardly through the floor face of the housing 4. The pair of barb portions 54 of each male terminal 5 are secured in the pair of slits 45 of the corresponding channel. The contacting sections of the male terminals 5 in the male connector 200 are aligned with each other along the lengthwise direction. The embosses 431 are flush with, or project beyond the contacting section of the male terminals 5 for protecting the contacting section. The pair of male retention portions 6 are insert molded with the male housing 4 for being surface mounted or soldered on the daughter board.

Figure 5:
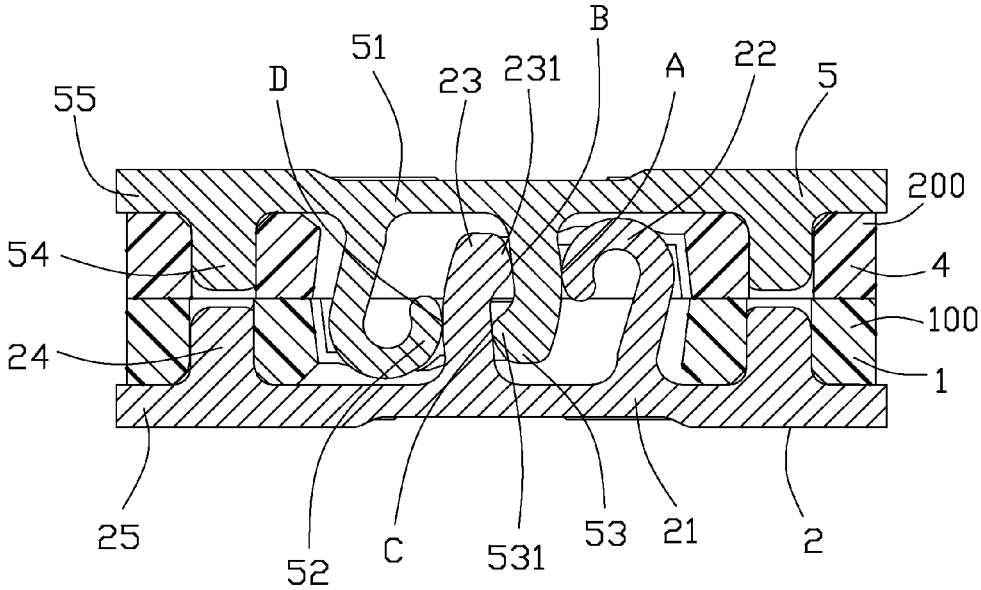
FIG. 5 is an cross-sectional view of the electrical connector assembly, taken along line 5-5 of FIG. 1.
Figure 6:
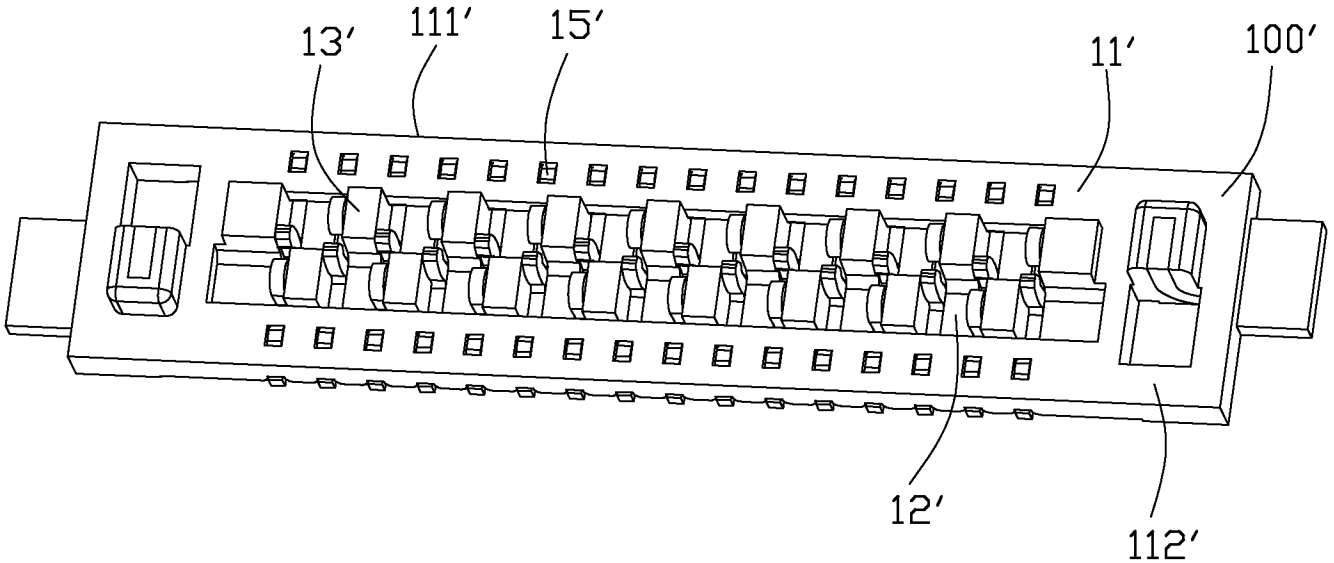
FIG. 6 is a perspective view showing a female connector of the electrical connector assembly of a second embodiment.
Figure 7:
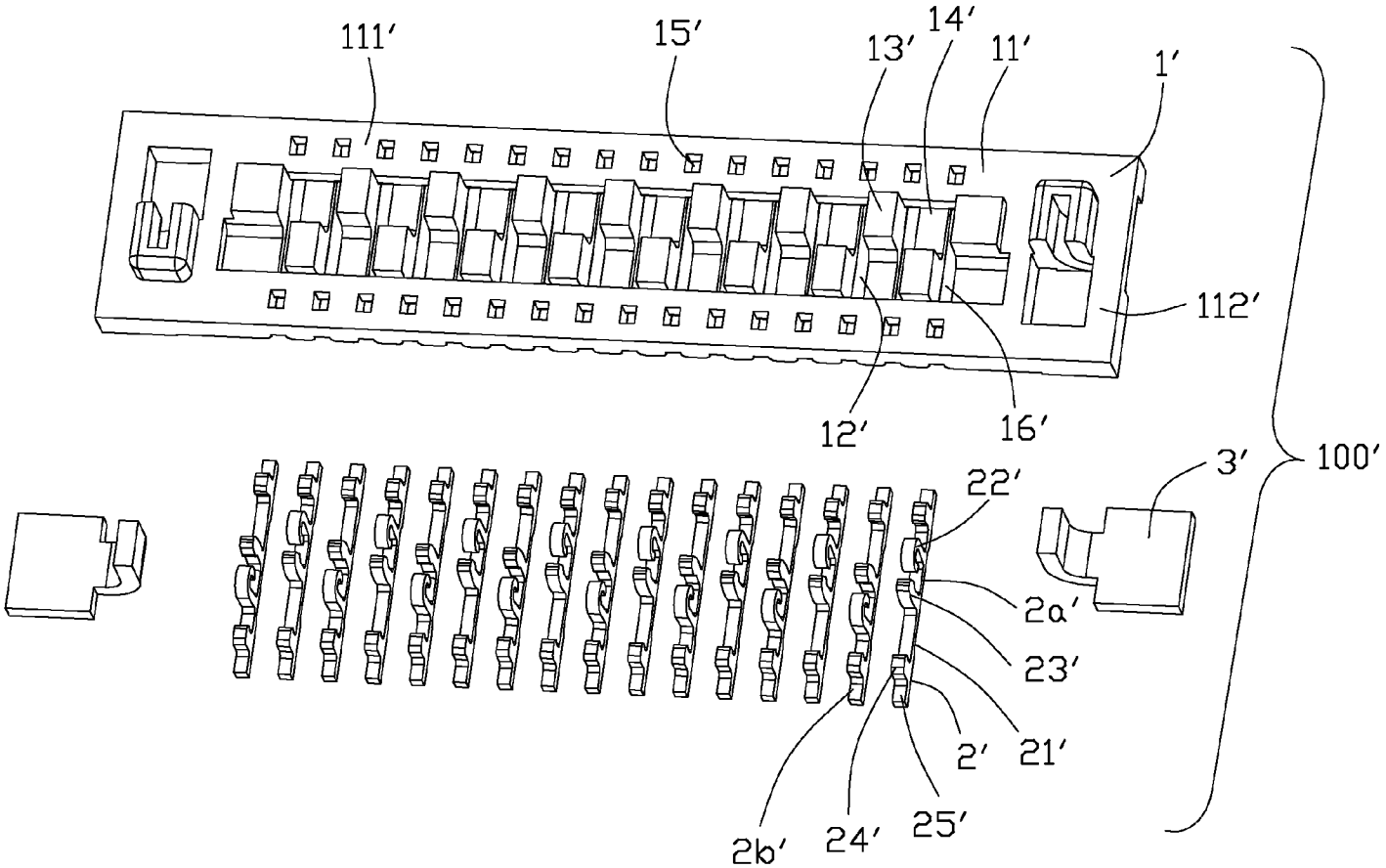
FIG. 7 is an exploded perspective view showing the female connector shown in FIG. 6.

In conjunction with FIG. 5, in the mating process, the male connector 200 moves on the female connector 100 till the standoffs 43 of the male connector 200 align with the indentations 14 of the female connector 100 and the standoffs 13 of the female connector 100 align with the indentations 44 of the male connector 200, along the mating direction. The male connector 200 then mates with the female connector 100 along the mating direction. The side walls 111 of the female connector 100 support the side walls 411 of the male connector 200. The standoffs 13, 43 and the indentations 14, 44 are used for blind mating.

The contacting section of the male connector 200 contacts with that of the female connector 100. The hook portion 531 of each male terminal 5 moves across the hook portion 231 of the corresponding female terminal 2 to provide lock hand feeling. The stiff contacting arm 53 of the male connector 200 is sandwiched between the stiff contacting arm 23 and the resilient contacting arm 22 of the female connector 100. The stiff contacting arm 23 of the female connector 200 is sandwiched between the stiff contacting arm 53 and the resilient contacting arm 52 of the male connector 200. The resilient contacting arms 22, 52 provide sufficient normal force to the mating stiff contacting arms 53, 23, respectively.

As shown in FIG. 5, the resilient contacting arm 22 of the female terminal 2 contacts with the stiff contacting arm 53 of the male terminal 5 at point A. The hook portion 231 of the stiff contacting arm 23 of the female terminal 2 contacts with the stiff contacting arm 53 of the male terminal 5 at point B. The hook portion 531 of the stiff contacting arm 53 of the male terminal 5 contacts with the stiff contacting arm 23 of the female terminal 2 at point C. The resilient contacting arm 52 of the male terminal 5 contacts with the stiff contacting arm 23 of the female terminal 2 at point D.

The pair of guiding posts 18 of the female connector 100 engage with the guiding holes 47 of the male connector 200, and the pair of guiding holes 17 of the female connector 100 engage with the guiding posts 48 of the male connector 200, respectively. The pair of enhanced walls 19 of the female connector 100 embrace the guiding posts 48 of the male connector 200, and the pair of enhanced walls 49 of the male connector 200 embrace the guiding posts 18 of the female connector 100, respectively. The guiding posts 18, 48, guiding holes 17, 47 and enhanced walls 19 are provided for blind mating.

Referring to FIGS. 6-9, in a second embodiment, the electrical connector assembly comprises a female connector 100' and a male connector 200' having identical configurations.

The female connector 100' comprises a female housing 1', a plurality of female terminals 2' assembled to the female housing 1' and a pair of female retention portions 3'.

The female housing 1' in the second embodiment has a configuration similar to that of the female housing 1 in the first embodiment. The female housing 1' comprises a base 11' and a lake portion 12' defined in the base 11'. The base 11' includes a pair of side walls 111', a pair of end portions 112' surrounding the lake portion 12', a plurality of standoffs 13' standing upwardly from the lake portion 12', and a plurality of indentations 14' each beside and aligned with the corresponding standoff 13' along the width direction. The female housing 1' further defines a plurality of channels (not labeled) communicating with the lake portion 12'. The channels and the standoffs 13' are arranged alternately along the lengthwise direction. Two adjacent standoffs 13' are staggered. Each channel includes a passageway 16' defined in the lake portion 12' and extending through a floor face of the base 11', and a pair of slits 15' respectively defined through the pair of side walls 111'.

In the second embodiment, the plurality of female terminals 2' of the female connector 100' comprise a plurality of first female terminals 2*a*' and second female terminals 2*b*' arranged alternately along the lengthwise direction. Each female terminal 2' includes a body portion 21', a pair of tail portions 25' extending from opposite ends of body portion 21', a pair of barb portions 24' respectively standing on the pair of tail portions 25', and a contacting section (not labeled) between the pair of barb portions 24'. The contacting section of each female terminal 2' comprises a stiff contacting arm 23' having a hook portion 231' and a curved resilient contacting arm 22' having a free end bent toward the stiff contacting arm 23'. The first female terminal 2*a*' is symmetrical to the second female terminal 2*b*', along an imaginary center line of the female terminal 2'. The contacting section of first female terminal 2*a*' and the contacting section of the second female terminal 2*b*' are symmetrical to each other along the imaginary center line and staggered with each other for better balance of normal force.

The male housing 4' in the second embodiment has a configuration identical to that of the female housing 1'.

The plurality of male terminals 5' of the male connector 200' comprise a plurality of first male terminals 5*a*' and second male terminals 5*b*' arranged alternately along the lengthwise direction. Each male terminal 5' includes a contacting section (not labeled) having a stiff contacting arm 53' having a hook portion 531' and a curved resilient contacting arm 52' having a free end bent toward the stiff contacting arm 23'. The contacting section of first male terminal 5*a*' and the contacting section of the second male terminal 5*b*' are symmetrical to each other along the imaginary center line and staggered with each other.

Figure 8:
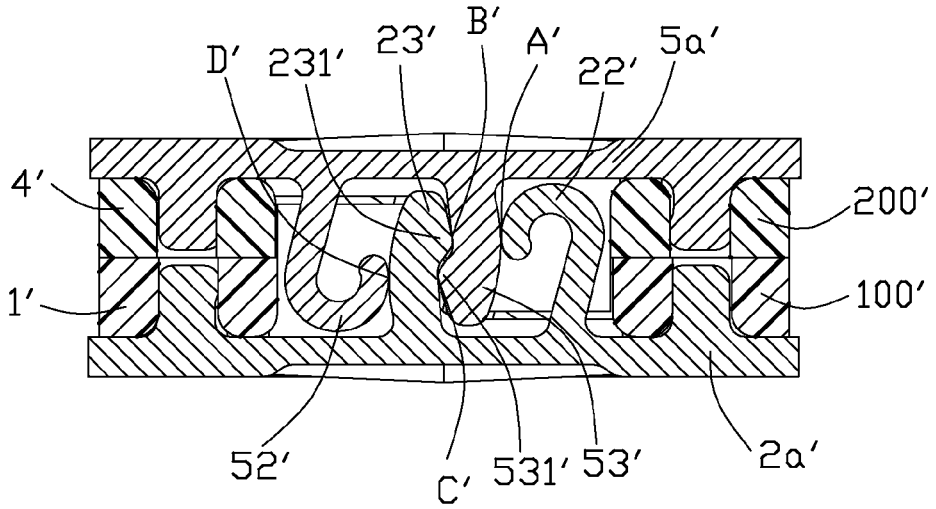
FIG. 8 is a cross-sectional view showing an engagement between a first female terminal of the female connector and a first male terminal of the male connector of the second embodiment.

In conjunction with FIG. 8, when the male connector 200' mates with the female connector 100, the contact sections of the male connector 200' contact with those of the female connector 100'. The hook portion 531' of each male terminal 5' moves across the hook portion 231' of the corresponding female terminal 2' to provide lock hand feeling. The stiff contacting arm 53' of the male connector 200' is sandwiched between the stiff contacting arm 23' and the resilient contacting arm 22' of the female connector 100'. The stiff contacting arm 23' of the female connector 200' is sandwiched between the stiff contacting arm 53' and the resilient contacting arm 52' of the male connector 200'. The resilient contacting arms 22', 52' provide sufficient normal force to the mating stiff contacting arms 53', 23', respectively.

As shown in FIG. 8, the resilient contacting arm 22' of the first female terminal 2*a* contacts with the stiff contacting arm 53 of the first male terminal 5*a* at point A'. The hook portion 231' of the stiff contacting arm 23' of the first female terminal 2*a*' contacts with the stiff contacting arm 53' of the first male terminal 5*a*' at point B'. The hook portion 531' of the stiff contacting arm 53' of the first male terminal 5*a*' contacts with the stiff contacting arm 23' of the first female terminal 2' at point C'. The resilient contacting arm 52' of the first male terminal 5*a*' contacts with the stiff contacting arm 23' of the first female terminal 2*a*' at point D'. The points A' through D' are arranged in sequence from right to left.

Figure 9:
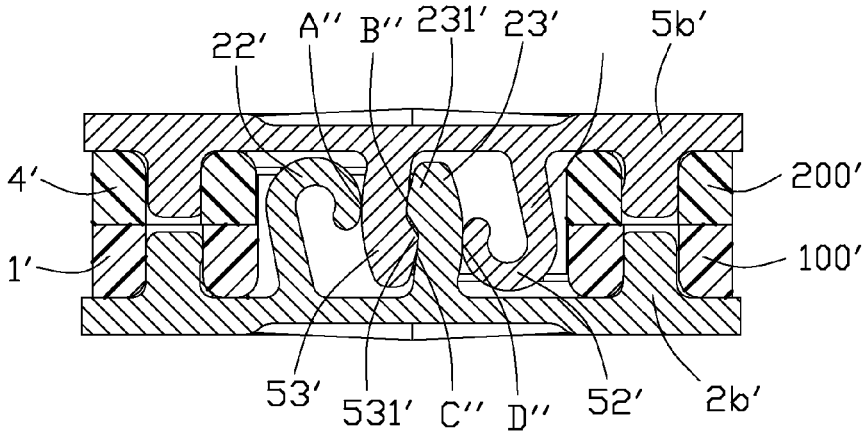
FIG. 9 is a cross-sectional view showing an engagement between a second female terminal of the female connector and a second male terminal of the male connector of the second embodiment.

As shown in FIG. 9, the resilient contacting arm 22' of the second female terminal 2*b*' contacts with the stiff contacting arm 53' of the second male terminal 5*b* at point A". The hook portion 231' of the stiff contacting arm 23' of second female terminal 2*b*' contacts with the stiff contacting arm 53' of the second male terminal 5*b*' at point B". The hook portion 531' of the stiff contacting arm 53' of the second male terminal 5*b*' contacts with the stiff contacting arm 23' of the second female terminal 2*b*' at point C". The resilient contacting arm 52' of the second male terminal 5*b*' contacts with the stiff contacting arm 23' of the second female terminal 2*b*' at point D". The points A" through D" are arranged in sequence from left to right.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a female connector and a male connector mating with each other, each of the female connector and the male connector including:

a housing having a plurality of channels and a plurality of standoffs arranged alternately along a lengthwise direction, and a plurality of indentations each defined beside a corresponding standoff, two adjacent standoffs being staggered; and a plurality of terminals each secured in a corresponding channel, each terminal having a contacting section, the contacting sections of the terminals of the female connector contacting with those of the terminals of the male connector, the standoffs of the male connector engaging with the indentations of the female connector.

2. The electrical connector assembly as claimed in claim 1, wherein said contacting section of each terminal comprises a stiff contacting arm and a curved resilient contacting arm having a free end bent toward the stiff contacting arm, the stiff contacting arm of the male connector is sandwiched between the stiff contacting arm and the resilient contacting arm of the female connector, and the stiff contacting arm of the female connector is sandwiched between the stiff contacting arm and the resilient contacting arm of the male connector.

3. The electrical connector assembly as claimed in claim 2, wherein said terminals of each of the male and female connectors have identical configurations, and said contacting sections of the terminals of each of the male and female connectors are aligned with each other along the lengthwise direction.

4. The electrical connector assembly as claimed in claim 2, wherein two adjacent terminals of each of the male and female connectors are symmetrical to each other, along an imaginary center line of the terminal, with said contacting sections of the two adjacent terminals staggered with each other.

5. The electrical connector assembly as claimed in claim 2, wherein each stiff contacting arm has a hook portion, said hook portions of the terminals of the male connector moving across the hook portions of the corresponding terminals of the female connector to provide lock hand feeling.

6. The electrical connector assembly as claimed in claim 1, wherein said housing of each of the female connector and the male connector comprises a base and a lake portion defined in the base, said channels communicating with the lake portion, said standoffs upstanding from the lake portion.

7. The electrical connector assembly as claimed in claim 6, wherein each channel includes a passageway defined in the lake portion and extending through a floor face of the base, and each terminal includes a body portion mounted in the passageway and a pair of tail portions extending from opposite ends of the body portion and exposed outwardly through the passageway.

8. The electrical connector assembly as claimed in claim 7, wherein said base of each of the male and female connectors includes a pair of side walls and a pair of end portions surrounding the lake portion, each channel defines a pair of slits respectively in the pair of side walls, and each terminal includes a pair of barb portions respectively extending vertically from the pair of tail portions and secured in the pair of slits of a corresponding channel.

9. The electrical connector assembly as claimed in claim 8, wherein each end portion of the housing includes a guiding post and a guiding hole beside the guiding post, said guiding posts of the female connector engaging with the guiding holes of the male connector, said guiding holes of the female connector engaging with the guiding posts of the male connector.

10. The electrical connector assembly as claimed in claim 9, wherein each end portion comprises an integrated L-shaped enhanced wall, said enhanced walls of the female connector embracing the guiding posts of the male connector, said enhanced walls of the male connector embracing the guiding posts of the female connector.

11. The electrical connector assembly as claimed in claim 8, further comprising two pairs of retention portions, each retention portion being insert molded with a corresponding end portion of the housing.

12. The electrical connector assembly as claimed in claim 1, wherein each standoff has an emboss formed at a top thereof, and said emboss is substantially higher than the contacting section of the terminal for protecting the contacting section.

13. An electrical connector for mating with another similar connector, comprising:

an insulative housing defining an upward mating face for face to face confronting another mating face of said another similar connector in a vertical direction, a plurality of standoffs upwardly protruding above the mating face in a staggered manner with regard to a lengthwise centerline of the housing along a lengthwise direction, a plurality of indentations downwardly recessed below the mating face in the staggered manner with regard to the lengthwise centerline along said lengthwise direction perpendicular to said vertical direction wherein the standoffs and the indentations are pairs in an alternative way by two sides of the lengthwise center in a transverse direction perpendicular to said lengthwise direction and said vertical direction for mating with corresponding paired standoffs and indentations of said another similar connector under condition that the standoffs of the housing are respectively received in the corresponding indentations of said another similar connector, and the standoffs of said another similar connector are respectively received in the indentations of the housing;

a plurality of terminals alternately arranged with the paired standoffs and indentations along the lengthwise direction for mating with corresponding terminals of said another similar connector.

14. The electrical connector as claimed in claim 13, wherein said terminals with keeps a same orientation or are arranged in an alternating way with opposite orientations along said lengthwise direction.

15. The electrical connector as claimed in claim 13, wherein each of said terminals defines two opposite retention portions by two sides of a contacting portion in said transverse direction under condition said retention portions are located below the mating face.

16. The electrical connector as claimed in claim 13, wherein said contacting portion includes a resilient contacting arm and a stiff contacting arm opposite to each other in said transverse direction.

17. The electrical connector as claimed in claim 16, wherein said resilient contacting arm and said stiff contacting arm are dimensioned and spaced with each other for allowing a corresponding stiff contacting arm to be received and sandwiched therebetween during mating.

18. The electrical connector as claimed in claim 17, wherein said stiff contacting arm defines a hook portion extending toward the corresponding resilient contacting arm for engagement with another hook portion of the corresponding terminal during mating.

19. The electrical connector as claimed in claim 16, wherein both said resilient contacting arm and said stiff contacting arm extend above the mating face.

* * * * *